US008786359B2

(12) United States Patent
Bhuiyan

(10) Patent No.: US 8,786,359 B2
(45) Date of Patent: Jul. 22, 2014

(54) CURRENT MIRROR DEVICE AND METHOD

(75) Inventor: Ekram Hossain Bhuiyan, San Jose, CA (US)

(73) Assignee: Sandisk Technologies Inc., Plano, TX (US)

( * ) Notice: Subject to any disclaimer, the term of this patent is extended or adjusted under 35 U.S.C. 154(b) by 137 days.

(21) Appl. No.: 11/954,924

(22) Filed: Dec. 12, 2007

(65) Prior Publication Data

US 2009/0153234 A1 Jun. 18, 2009

(51) Int. Cl.
*G05F 1/10* (2006.01)

(52) U.S. Cl.
USPC ..... 327/540; 323/317; 327/103

(58) Field of Classification Search
USPC ..... 327/103
See application file for complete search history.

(56) References Cited

U.S. PATENT DOCUMENTS

| | | | | | |
|---|---|---|---|---|---|
| 4,072,910 | A | * | 2/1978 | Dingwall et al. | 331/57 |
| 4,412,186 | A | * | 10/1983 | Nagano | 330/288 |
| 4,583,037 | A | * | 4/1986 | Sooch | 323/315 |
| 4,687,984 | A | * | 8/1987 | Butler | 323/315 |
| 4,918,336 | A | * | 4/1990 | Graham et al. | 326/117 |
| 5,087,891 | A | * | 2/1992 | Cytera | 330/288 |
| 5,231,316 | A | * | 7/1993 | Thelen, Jr. | 327/103 |
| 5,412,349 | A | * | 5/1995 | Young et al. | 331/34 |
| 5,596,302 | A | * | 1/1997 | Mastrocola et al. | 331/57 |
| 5,610,547 | A | * | 3/1997 | Koyama et al. | 327/350 |
| 5,654,629 | A | * | 8/1997 | Theus | 323/316 |
| 5,686,867 | A | * | 11/1997 | Sutardja et al. | 331/57 |
| 5,748,048 | A | * | 5/1998 | Moyal | 331/34 |
| 5,790,060 | A | * | 8/1998 | Tesch | 341/119 |
| 5,815,012 | A | * | 9/1998 | Rivoir et al. | 327/103 |
| 5,841,386 | A | * | 11/1998 | Leduc | 341/143 |
| 5,952,884 | A | * | 9/1999 | Ide | 330/288 |
| 5,959,446 | A | * | 9/1999 | Kuckreja | 323/315 |
| 6,057,716 | A | * | 5/2000 | Dinteman et al. | 327/108 |
| 6,194,920 | B1 | * | 2/2001 | Oguri | 327/65 |
| 6,229,403 | B1 | * | 5/2001 | Sekimoto | 331/57 |
| 6,249,176 | B1 | | 6/2001 | Pease | |
| 6,255,895 | B1 | * | 7/2001 | Kim et al. | 327/530 |
| 6,297,688 | B1 | | 10/2001 | Nakamura | |
| 6,353,402 | B1 | * | 3/2002 | Kanamori | 341/118 |
| 6,362,698 | B1 | * | 3/2002 | Gupta | 331/117 FE |
| 6,414,535 | B1 | * | 7/2002 | Ooishi | 327/538 |

(Continued)

FOREIGN PATENT DOCUMENTS

| | | | |
|---|---|---|---|
| CN | 101083467 | A | 12/2007 |
| EP | 1160642 | A1 | 12/2001 |

(Continued)

OTHER PUBLICATIONS

International Search Report and Written Opinion of the International Searching Authority for International Application No. PCT/US2008/085905 dated Mar. 2, 2009, 16 pages.

(Continued)

*Primary Examiner* — Thomas J Hiltunen
(74) *Attorney, Agent, or Firm* — Toler Law Group, PC

(57) ABSTRACT

In an embodiment, a circuit is disclosed that includes a current mirror including a first transistor pair and a second transistor pair. The first transistor pair includes a first transistor and a second transistor. The second transistor pair includes cascode transistors. The circuit also includes an operational amplifier having an output coupled to both the first transistor and the second transistor.

22 Claims, 4 Drawing Sheets

(56) References Cited

U.S. PATENT DOCUMENTS

| | | | | |
|---|---|---|---|---|
| 6,445,223 | B1 * | 9/2002 | Thilenius | 327/108 |
| 6,445,322 | B2 * | 9/2002 | Watson | 341/144 |
| 6,462,527 | B1 * | 10/2002 | Maneatis | 323/315 |
| 6,492,845 | B1 * | 12/2002 | Ge et al. | 327/53 |
| 6,518,846 | B2 * | 2/2003 | Ichihara | 331/57 |
| 6,531,857 | B2 * | 3/2003 | Ju | 323/316 |
| 6,587,000 | B2 | 7/2003 | Oikawa | |
| 6,639,456 | B2 | 10/2003 | Paulus | |
| 6,707,286 | B1 | 3/2004 | Gregoire, Jr. | |
| 6,720,818 | B1 * | 4/2004 | Liu et al. | 327/408 |
| 6,738,006 | B1 * | 5/2004 | Mercer et al. | 341/144 |
| 6,747,585 | B2 * | 6/2004 | Plymale et al. | 341/144 |
| 6,784,755 | B2 * | 8/2004 | Lin et al. | 331/57 |
| 6,894,556 | B2 * | 5/2005 | Kawasumi | 327/541 |
| 6,903,539 | B1 | 6/2005 | Hoon et al. | |
| 6,963,251 | B2 * | 11/2005 | Liu | 331/57 |
| 7,109,785 | B2 * | 9/2006 | Derksen | 327/543 |
| 7,126,431 | B2 * | 10/2006 | Mintchev et al. | 331/57 |
| 7,171,323 | B2 * | 1/2007 | Shipton et al. | 702/106 |
| 7,199,646 | B1 * | 4/2007 | Zupcau et al. | 327/539 |
| 7,312,651 | B2 * | 12/2007 | Kudo | 327/540 |
| 7,319,310 | B2 * | 1/2008 | Grove | 323/265 |
| 7,336,134 | B1 * | 2/2008 | Janesch et al. | 331/36 C |
| 7,345,528 | B2 * | 3/2008 | Zanchi et al. | 327/562 |
| 7,388,531 | B1 * | 6/2008 | Cyrusian | 341/144 |
| 7,443,327 | B2 | 10/2008 | Chida et al. | |
| 7,463,082 | B2 | 12/2008 | Chen | |
| 7,471,139 | B2 * | 12/2008 | Khalid | 327/541 |
| 7,492,198 | B2 * | 2/2009 | Suda | 327/158 |
| 7,639,081 | B2 * | 12/2009 | Arakali et al. | 330/288 |
| 8,054,139 | B2 * | 11/2011 | Fernandez et al. | 331/57 |
| 8,081,099 | B2 * | 12/2011 | Ikoma et al. | 341/144 |
| 2002/0109492 | A1 * | 8/2002 | Bonelli et al. | 323/315 |
| 2002/0149432 | A1 * | 10/2002 | Hsu et al. | 331/36 C |
| 2003/0042970 | A1 * | 3/2003 | Humphrey | 327/540 |
| 2003/0112057 | A1 * | 6/2003 | Mihara | 327/540 |
| 2003/0218502 | A1 * | 11/2003 | MacTaggart et al. | 330/254 |
| 2004/0080342 | A1 * | 4/2004 | Murakami | 327/8 |
| 2005/0104574 | A1 | 5/2005 | Hoon et al. | |
| 2005/0258910 | A1 * | 11/2005 | Tung | 331/18 |
| 2006/0023545 | A1 * | 2/2006 | Ito et al. | 365/222 |
| 2006/0087780 | A1 * | 4/2006 | Chen | 361/56 |
| 2006/0103451 | A1 * | 5/2006 | Lim et al. | 327/540 |
| 2006/0125463 | A1 * | 6/2006 | Yen et al. | 323/316 |
| 2006/0132180 | A1 * | 6/2006 | Omori et al. | 326/82 |
| 2006/0132253 | A1 * | 6/2006 | Gelhausen et al. | 331/167 |
| 2006/0290418 | A1 | 12/2006 | Wong et al. | |
| 2007/0057717 | A1 | 3/2007 | Choi | |
| 2007/0090860 | A1 | 4/2007 | Hsu | |
| 2007/0108958 | A1 * | 5/2007 | Minakuchi et al. | 323/316 |
| 2007/0194837 | A1 | 8/2007 | Chiou et al. | |
| 2007/0229150 | A1 | 10/2007 | Galal | |
| 2007/0279120 | A1 * | 12/2007 | Brederlow et al. | 327/389 |
| 2008/0042738 | A1 * | 2/2008 | Kang | 327/540 |

FOREIGN PATENT DOCUMENTS

| | | | |
|---|---|---|---|
| GB | 2347524 | A | 9/2000 |
| JP | 2007-102563 | A | 4/2007 |
| JP | 2007102563 | A | 4/2007 |
| JP | 2007219901 | A | 8/2007 |
| TW | 476872 | B | 2/2002 |
| TW | M302832 | U | 12/2006 |
| TW | 200733044 | | 9/2007 |
| WO | 0020942 | A1 | 4/2000 |

OTHER PUBLICATIONS

Vincence, V.C. et al. "A High-Swing MOS Cascade Bias Circuit for Operation at any Current Level", IEEE International Symposium on Circuits and Systems, May 28-31, 2000, Geneva, Switzerland, pp. 489-492.

Office Action issued May 24, 2012 in Taiwanese Application No. 097148571, with English translation, 7 pages.

First Office Action issued Jun. 21, 2012 in Chinese Application No. 200880119096.6, with English translation, 13 pages.

Second Office Action issued Oct. 26, 2012 in Taiwanese Application No. 097148571, with English translation, 15 pages.

Second Office Action issued Mar. 13, 2013 in Chinese Application No. 200880119096.6, with English translation, 5 pages.

Communication Pursuant to Article 94(3) EPC issued Mar. 27, 2013 in European Application No. 08859669.7, 8 pages.

International Preliminary Report on Patentability for International Application No. PCT/US2008/085905, issued Jun. 15, 2010, 7 pages.

Office Action issued Aug. 26, 2013, in Taiwanese Application No. 097148571, with English translation, 6 pages.

* cited by examiner

CURRENT MIRROR DEVICE AND METHOD

I. FIELD

The present disclosure is generally related to current mirror devices and methods of using current mirror devices.

II. DESCRIPTION OF RELATED ART

Advances in electronic device technology have resulted in smaller devices that consume less power during operation. Reduced power consumption is often a result of smaller device features and devices operating at lower supply voltages. However, as supply voltages decrease, device operation often becomes more sensitive to fluctuations in the supply voltage. In addition, some devices include multiple voltage domains to accommodate circuits that operate at different supply voltages. However, a supply voltage for a second voltage domain generated by circuitry of a first voltage domain may be sensitive to fluctuations of the supply voltage of the first voltage domain.

Conventional current mirror circuits require voltage supply headroom that may be unacceptable for certain low voltage applications. In addition, the output current of a traditional current mirror circuit has a dependency on the supply voltage. In addition, an output with a fast voltage swing may introduce coupling between the output, gate, and source, of transistors of a conventional current mirror circuit. Thus, conventional circuit mirror circuits may be impractical to drive low voltage, high frequency loads.

III. SUMMARY

In a particular embodiment, a circuit is disclosed that includes a current mirror including a first set of transistors and a second set of transistors. At least one of the transistors in the first set of transistors and at least one of the transistors in the second set of transistors is in a cascode arrangement. The circuit includes a first operational amplifier coupled to the first set of transistors. The circuit also includes a second operational amplifier coupled to the second set of transistors.

In another embodiment, the circuit includes a current mirror including a first transistor pair and a second transistor pair. The first transistor pair includes a first transistor and a second transistor. The second transistor pair includes cascode transistors. The circuit also includes a first operational amplifier having an output coupled to both the first transistor and the second transistor.

In another embodiment, the circuit includes a current mirror including a first set of transistors and a second set of transistors. At least one transistor in the second set of transistors is disposed in a cascode arrangement. The circuit includes a first operational amplifier coupled to the first set of transistors. The circuit also includes a second operational amplifier coupled to the second set of transistors. The circuit includes a current source coupled to one of the transistors of the second set of transistors. The first operational amplifier has a first input of a first bias voltage and the second operational amplifier has a first input of a second bias voltage. The first set of transistors is coupled to a supply voltage. The first bias voltage is different than the supply voltage. A first of the transistors of the second set of transistors is coupled to a second input to the first operational amplifier to define a first feedback loop. An output of one of the transistors in the first set of transistors is provided as a second input to the second operational amplifier to define a second feedback loop. A second of the transistors of the second set of transistors has an output that drives an output current.

In another embodiment, a method of using a circuit device is disclosed. The method includes receiving a first bias voltage at a first input of a first operational amplifier coupled to a first set of transistors. The method includes receiving a second bias voltage at a first input of a second operational amplifier coupled to a second set of transistors. The first set of transistors and the second set of transistors form a current mirror. The current mirror is coupled to a supply voltage, and the first bias voltage differs from the supply voltage. A first of the transistors in the second set of transistors is coupled to a second input of the first operational amplifier to define a first feedback loop. An output of one of the transistors in the first set of transistors is provided as a second input to the second operational amplifier to define a second feedback loop. A second of the transistors of the second set of transistors has an output that drives an output current of the current mirror.

One particular advantage provided by embodiments of the current mirror is robust operation since the output current is insensitive to variations in the voltage supply. Another advantage is that a voltage domain may be supplied with an output voltage level held at a reference voltage level that is independent of the supply voltage of the current mirror circuit. Another advantage is that low power operation is enabled by operation at a low supply voltage. The disclosed current mirror circuit device can drive a high frequency oscillator with lower supply voltage, better output impedance, and increased insensitivity to fast output voltage swings.

Other aspects, advantages, and features of the present disclosure will become apparent after review of the entire application, including the following sections: Brief Description of the Drawings, Detailed Description, and the Claims.

IV. BRIEF DESCRIPTION OF THE DRAWINGS

V. DETAILED DESCRIPTION

Figure 1:
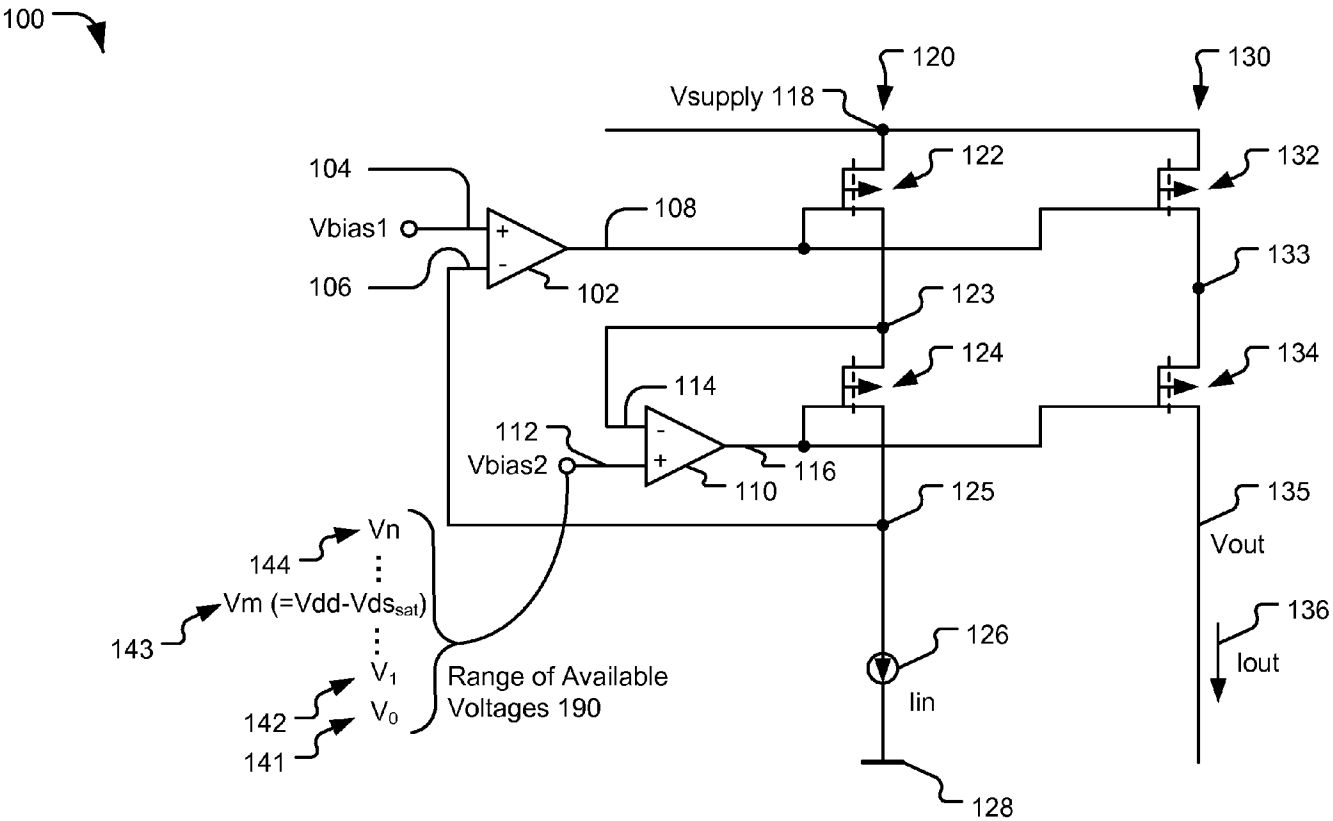
FIG. 1 is a circuit diagram of a first embodiment of a current mirror device.

Referring to FIG. 1, a circuit device 100 is illustrated. The circuit device 100 includes a first operational amplifier 102 and a second operational amplifier 110. The circuit device 100 also includes a current mirror including a first set of transistors, such as a first pair of transistors including a first transistor 122 and a second transistor 132 and a second set of transistors, such as a second pair of transistors including a third transistor 124 and a fourth transistor 134. At least one of the transistors in the second set of transistors is in a cascode arrangement. For example, the transistor 124 or the transistor 134 or both may be in a cascode arrangement. The first operational amplifier 102 is coupled to the first transistor 122 and to the second transistor 132. The first operational amplifier 102 has a first input of a first bias voltage (Vbias1) 104 and has a second input 106 responsive to a feedback signal that is provided from a node 125 coupled to the third transistor 124.

The second operational amplifier 110 has a first input 114 responsive to a node 123 coupled to the first transistor 122 and a second input 112 which is responsive to a second bias voltage (Vbias2). In a particular embodiment, the second bias voltage provided at input 112 is substantially fixed and independent of variations of a supply voltage 118 provided to the current mirror via current paths 120 and 130. In a particular example, the second bias voltage can be set to a range 190 of available voltages 141-144, such as the supply voltage 118 less the drain to source saturation voltage ($Vdd-Vds_{sat}$) 143 of a single transistor.

The transistors 122 and 124 in the first current path 120 are coupled to receive an input from a current source 126 that is coupled to the node 125 and to ground 128. The transistors 132 and 134 in the second current path 130 are coupled to provide an output voltage and an output current 136 at output node 135. The output current 136 is provided by an output of the fourth transistor 134. The output voltage of the current mirror is limited by the second bias voltage.

In a particular embodiment, the first transistor pair (122 and 132) is coupled to the supply voltage 118, and the supply voltage 118 is different from the first bias voltage 104 and the second bias voltage 112. Thus, variations in the supply voltage 118 are isolated from other parts of the circuit 100 by use of the bias voltages 104 and 112.

During operation, an output of the third transistor 124 is provided as an input to the first operation amplifier 102 via node 125 to define a first feedback loop. In addition, an output of the first transistor 122 is provided as an input to the second operational amplifier 110 via node 123 to define a second feedback loop. The feedback loops enable the operational amplifiers 102 and 110 to maintain constant bias independent of the supply voltage 118.

In a particular embodiment, each of the transistors 122, 124, 132, 134 in the first and second sets of transistors that define the current mirror are field effect type transistors as illustrated. An example of a suitable field effect type transistor is a metal oxide field effect transistor (MOSFET).

Figure 2:
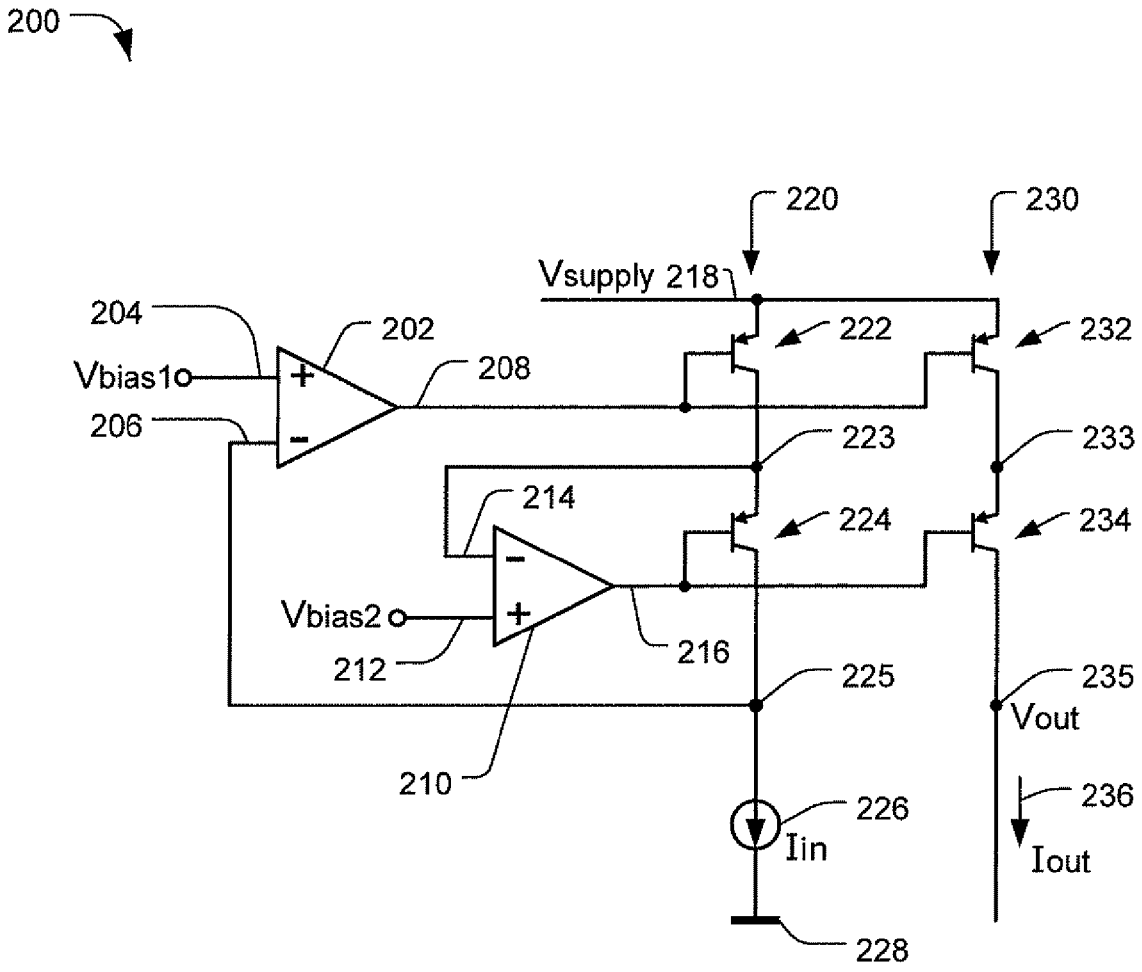
FIG. 2 is a circuit diagram of a second embodiment of a current mirror device.

In another embodiment illustrated in FIG. 2, each of the four transistors in the current mirror are bipolar transistor type devices. For example, the first transistor 222, the second transistor 224, the third transistor 232, and the fourth transistor 234 are each bipolar type devices as illustrated. The remaining portions of the circuit device 200 illustrated in FIG. 2 are substantially similar to the elements shown in respect to FIG. 1.

Figure 3:
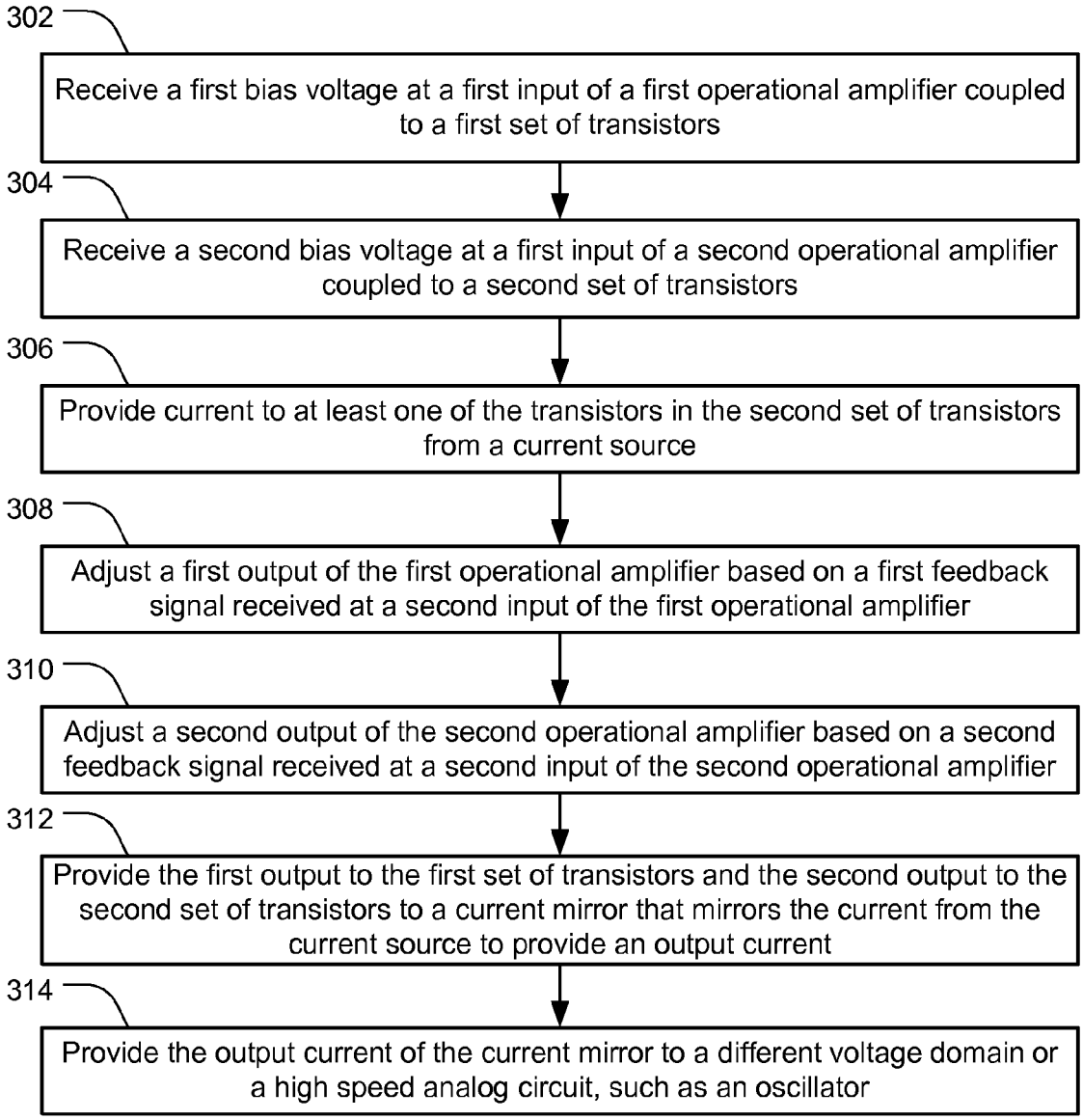
FIG. 3 is a flow chart of an embodiment of method of using a current device.

Referring to FIG. 3, a method of using a circuit device, such as the circuit devices illustrated in FIG. 1 and FIG. 2, is shown. The method of using the circuit device includes receiving a first bias voltage at a first input of a first operational amplifier that is coupled to a first set of transistors, at 302. An example of the first operational amplifier is the first operational amplifier 102 in FIG. 1 or the first operational amplifier 202 in FIG. 2. An example of the first bias voltage is the first bias voltage (Vbias1) provided at input 104 in FIG. 1 or at the input 204 in FIG. 2. The method includes receiving a second bias voltage at a first input of a second operational amplifier that is coupled to a second set of transistors, as shown at 304. An example of a second bias voltage provided to a second operational amplifier is the second bias voltage (Vbias2) 112 provided to the second operational amplifier 110 in FIG. 1 or the second bias voltage 212 provided to the second operational amplifier 210 in FIG. 2.

The method further includes providing current to at least one of the transistors in the second set of transistors from a current source. An example of an appropriate current source is the current source 126 shown in FIG. 1 or the current source 226 shown in FIG. 2. The second set of transistors may include a second transistor pair such as the transistors 124 and 134 shown in FIG. 1 or the transistors 224 and 234 shown in FIG. 2.

The method further includes adjusting a first output of the first operational amplifier based on a first feedback signal received at a second input of the first operational amplifier, as shown at 308. A first of the transistors of the second set of transistors is coupled to the second input to the first operational amplifier to define a first feedback loop. For example, the first output of the first operational amplifier 102 may be adjusted based on a feedback signal received at the second input 106 provided by the first feedback loop coupled to node 125, as shown in FIG. 1.

The method further includes adjusting a second output of the second operational amplifier based on a second feedback signal received at a second input of the second operational amplifier, at 310. An output of one of the transistors in the first set of transistors is provided as the second input to the second operational amplifier to define a second feedback loop. For example, the second output 116 of the second operational amplifier 110 may be adjusted in response to an input received at 114 via the second feedback loop provided in response to transistor 122 coupled via node 123, as shown in FIG. 1.

The method further includes providing the first output from the first operational amplifier to the first set of transistors and providing the second output of the second operational amplifier to the second set of transistors of a current mirror that mirrors current from the current source to provide a resulting output current, as shown at 312. For example, the first output 108 from the first operational amplifier 102 may be provided to the current mirror including transistors 122, 132, 124, 134, such that the current provided through a first current path 120 is mirrored and a substantially equal current is then provided via an output of a transistor of the second current path 130, which drives an output current 136 that substantially matches the input current 126, as shown in FIG. 1. The method further includes providing the output current of the current mirror to a high speed analog circuit, as shown at 314. The output current 136, or the output current 236, may be provided to a high speed analog circuit, such as an oscillator or other similar type of analog circuit. In addition, the output voltage associated with the output current 136 may be provided to a different voltage domain where the different voltage domain has a voltage supply limited by the second bias voltage 112 provided to the second operational amplifier 110. In this manner, separate and isolated voltage supplies may be provided to different voltage domains within an integrated circuit device.

In a particular embodiment, the second bias voltage is a fixed and substantially stable voltage that may be provided by a reference voltage circuit. In a particular embodiment, the supply voltage, such as the supply voltage 118 in FIG. 1 or the supply voltage 218 in FIG. 2, is approximately equal to four times the drain to source voltage (Vds) of one of the transistors in the first set of transistors, such as the drain to source voltage of transistors 122 or 132 in FIG. 1. In a particular embodiment, the supply voltage is less than one volt and may be approximately equal to 0.8 volts in the case where the drain to source voltage is approximately 0.2 volts.

Figure 4:
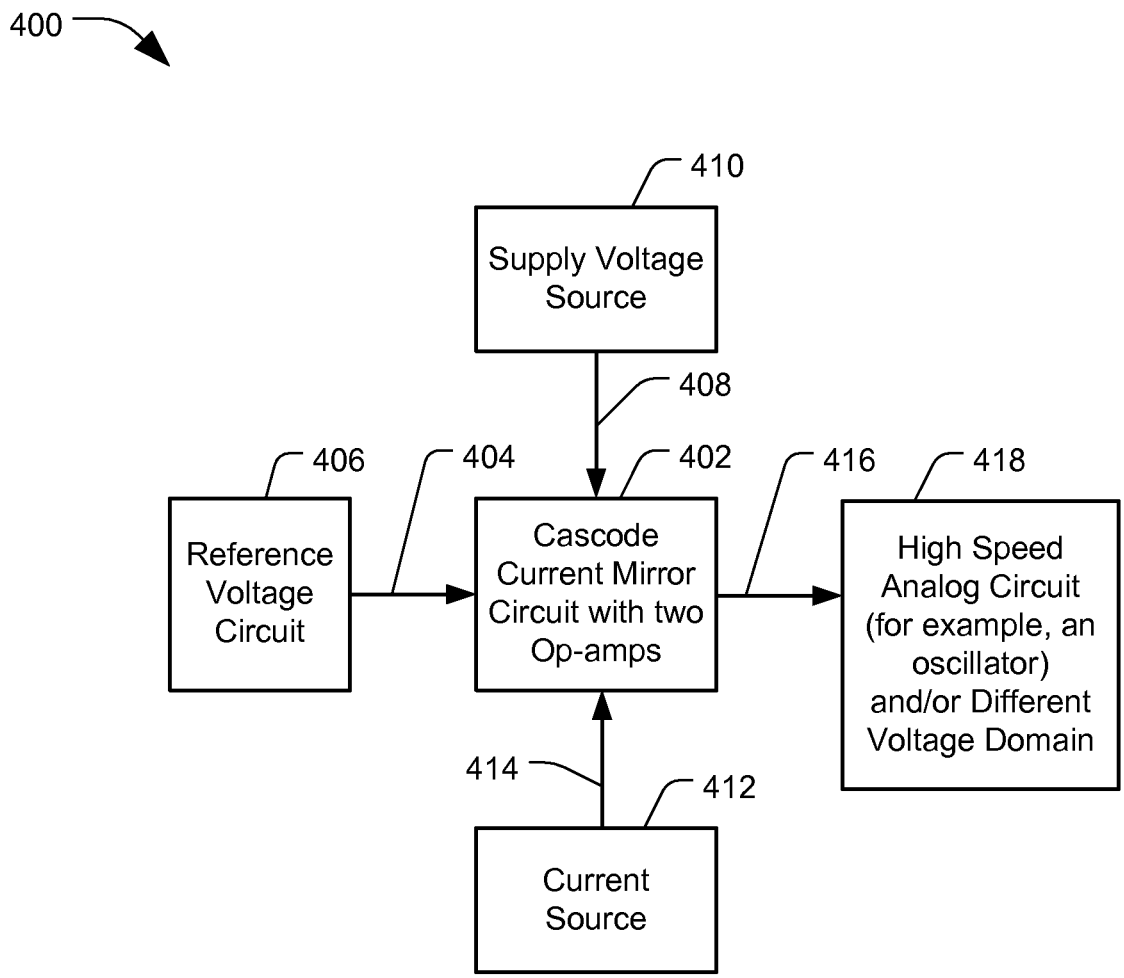
FIG. 4 is a block diagram of a system including a current mirror circuit.

Referring to FIG. 4, a particular illustrative embodiment of a system 400 that includes a cascode current mirror circuit, such as the circuit devices shown in FIG. 1 and FIG. 2, is illustrated. The system 400 includes a supply voltage source 410 which is provided via supply line 408 to the cascode current mirror circuit including two or more operational amplifiers 402. In a particular embodiment, the current mirror with operational amplifiers 402 is a circuit, such as those illustrated with respect to FIG. 1 or FIG. 2. The cascode current mirror device 402 is responsive to a current source 412 and receives current at an input 414. In addition, the cascode current mirror device 402 receives a reference voltage 404 from a reference voltage circuit 406. In a particular embodiment, the reference voltage circuit 406 may be a band gap type reference voltage circuit to provide a substantially stable and fixed voltage. In a particular embodiment, the reference voltage circuit 406 provides a first bias voltage and a second bias voltage as inputs to two operational amplifiers of the cascode current mirror device 402. The cascode current mirror device 402 provides an output current 416 and an output voltage to a representative high speed analog circuit device and/or a different voltage domain 418. In a particular embodiment, the high speed analog circuit device and/or different voltage domain 418 is an oscillator or similar high frequency circuit.

With the disclosed circuits and systems, an improved current mirror may exhibit higher effective output impedance, lower supply voltage and increased insensitive to fast output voltage swing. Two operational amplifier loops are used to regulate top and bottom transistor pairs in a cascode arrangement of a current mirror device to improve a resulting output impedance and to reduce supply voltage requirements. In addition, while a first and second current path has been shown in FIG. 1 and FIG. 2, it should be understood that additional parallel current paths can be added to provide multiple current outputs of the current mirror. In addition, the input current source may be implemented using additional cascode transistors. In this case, the minimum voltage required for each of the paths of the current mirror is only four times the drain to source saturation voltage of a single transistor, which is approximately equal to 0.8 volts.

In addition, the disclosed circuit device may beneficially provide a current mirror that can adjust quickly to high speed analog circuits, such as oscillator and similar applications. With the disclosed circuit device, the current ratio of the current mirror is substantially independent of the supply voltage. Therefore, the disclosed circuit has decreased sensitivity of the output current versus the supply voltage to the current mirror circuit. As such, the disclosed current mirror circuit with multiple operational amplifiers provides an improvement for high speed analog circuit device operations at low voltages.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be reduced. Although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description. Accordingly, the disclosure and the figures are to be regarded as illustrative rather than restrictive.

The Abstract of the Disclosure is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all of the features of any of the disclosed embodiments. Thus, the following claims are incorporated into the Detailed Description, with each claim standing on its own as defining separately claimed subject matter.

The above-disclosed subject matter is to be considered illustrative, and not restrictive, and the appended claims are intended to cover all modifications, enhancements, and other embodiments, which fall within the true spirit and scope of the present invention. Thus, to the maximum extent allowed by law, the scope of the present invention is to be determined by the broadest permissible interpretation of the following claims and their equivalents, and shall not be restricted or limited by the foregoing detailed description.

What is claimed is:

1. A circuit comprising:

a current mirror including a first set of transistors and a second set of transistors, at least one of the transistors in the first set of transistors and at least one of the transistors in the second set of transistors in a cascode arrangement;

a first operational amplifier coupled to the first set of transistors and including an input of a first bias voltage determined by a reference voltage circuit;

a second operational amplifier coupled to the second set of transistors and including an input of a second bias voltage determined by the reference voltage circuit that sets the second bias voltage to one of a plurality of selectable voltage levels within a range of voltages;

wherein a first transistor of the first set of transistors has an input coupled to a voltage supply and an output coupled to an input of a first transistor of the second set of transistors, wherein an output of the first transistor in the second set of transistors is provided as an input to the first operational amplifier to define a first feedback loop, wherein the output of the first transistor in the first set of transistors is provided to an input of the first transistor of the second set of transistors, wherein a second transistor of the first set of transistors has an input coupled to the voltage supply and an output coupled to an input of a second transistor of the second set of transistors, wherein the second transistor of the second set of transistors has an output that drives an output current to a different voltage domain, wherein the different voltage domain has a voltage supply limited by the second bias voltage, and wherein the second transistor of the second set of transistors is directly coupled to the second operational amplifier; and a current source coupled to the first transistor of the second set of transistors;

wherein the current source is an active device that includes cascode transistors; and wherein each transistor of the second set of transistors is controlled by the second operational amplifier.

2. The circuit of claim 1, wherein the first transistor of the first set of transistors and the second transistor of the first set of transistors comprise a first transistor pair and the first transistor of the second set of transistors and the second transistor of the second set of transistors comprise a second transistor pair.

3. The circuit of claim 1, wherein an output voltage of the current mirror is limited by the second bias voltage.

4. The circuit of claim 1, wherein the output of the first transistor in the first set of transistors is provided as an input to the second operational amplifier to define a second feedback loop.

5. The circuit of claim 1, wherein the first transistor of the first set of transistors, the second transistor of the first set of transistors, the first transistor of the second set of transistors, and the second transistor of the second set of transistors are each field effect type transistor devices.

6. The circuit of claim 1, further comprising a node, wherein the second transistor of the second set of transistors includes a gate terminal that is directly connected to the node, wherein the second operational amplifier includes an output portion that is directly connected to the node, and wherein the second operational amplifier is configured to generate an output signal that is provided directly to the gate terminal via the node.

7. The circuit of claim 1, wherein the first transistor of the first set of transistors and the first transistor of the second set of transistors are included in a first current path of the current mirror, wherein the second transistor of the first set of transistors and the second transistor of the second set of transistors are included in a second current path of the current mirror, and wherein the current mirror further includes a third current path.

8. A circuit comprising:

a current mirror including a first transistor pair and a second transistor pair, the first transistor pair including a first transistor and a second transistor, the second transistor pair including cascode transistors, wherein the current mirror is configured to provide an output current to a high speed analog circuit;

a first operational amplifier having an input of a first bias voltage and an output coupled to both the first transistor and the second transistor; and a second operational amplifier coupled to each transistor in the second transistor pair and including an input of a second bias voltage determined by a reference voltage circuit that sets the second bias voltage to one of a plurality of selectable voltage levels within a range of voltages;

wherein the first transistor of the first transistor pair has an input coupled to a voltage supply and an output coupled to an input of a first transistor of the second transistor pair, wherein the second transistor of the first transistor pair has an input coupled to the voltage supply and an output coupled to an input of a second transistor of the second transistor pair, and wherein the second transistor of the second transistor pair has an output that drives the output current provided to a different voltage domain, wherein the different voltage domain has a voltage supply limited by the second bias voltage, and wherein the second transistor of the second transistor pair is directly coupled to the second operational amplifier; and a current source coupled to the first transistor of the second transistor pair;

wherein the current source is an active device that includes cascode transistors; and wherein each transistor of the second transistor pair is controlled by the second operational amplifier.

9. The circuit of claim 8, wherein an input to the current source is coupled to an input of the first operational amplifier, and wherein the output current provided to the high speed analog circuit substantially matches a current provided by the current source.

10. The circuit of claim 8, wherein the first bias voltage and the second bias voltage are different.

11. The circuit of claim 8, wherein the first transistor pair includes at least one field effect type transistor device.

12. A circuit comprising:

a current mirror including a first set of transistors and a second set of transistors, at least one transistor in the second set of transistors disposed in a cascode arrangement;

a first operational amplifier coupled to the first set of transistors;

a second operational amplifier coupled to the second set of transistors;

a current source coupled to a first transistor of the second set of transistors;

wherein the current source is an active device that includes cascode transistors;

wherein the first operational amplifier has a first input of a first bias voltage and the second operational amplifier has a first input of a second bias voltage determined by a reference voltage circuit that sets the second bias voltage to one of a plurality of selectable voltage levels within a range of available voltages;

wherein a first transistor of the first set of transistors has an input coupled to a supply voltage and an output coupled to an input of a first transistor of the second set of transistors, wherein a second transistor of the first set of transistors has an input coupled to the supply voltage and an output coupled to an input of a second transistor of the second set of transistors, wherein the first bias voltage is different than the supply voltage, and wherein the second transistor of the second set of transistors is directly coupled to the second operational amplifier;

wherein the first transistor of the second set of transistors is coupled to a second input to the first operational amplifier to define a first feedback loop;

wherein an output of the first transistor in the first set of transistors is provided as a second input to the second operational amplifier to define a second feedback loop;

wherein the second transistor of the second set of transistors has an output that drives an output current provided to a high speed analog circuit and provided to a different voltage domain, wherein the different voltage domain has a voltage supply limited by the second bias voltage; and wherein each transistor of the second set of transistors is controlled by the second operational amplifier.

13. The circuit of claim 12, wherein the first transistor of the first set of transistors, the second transistor of the first set of transistors, the first transistor of the second set of transistors, and the second transistor of the second set of transistors are each field effect type transistor devices.

14. The circuit of claim 12, wherein the output current is substantially insensitive to changes in the supply voltage.

15. The circuit of claim 12, wherein the second bias voltage is substantially fixed and independent of variations of the supply voltage.

16. A method of using a circuit device, the method comprising:

receiving a first bias voltage at a first input of a first operational amplifier coupled to a first set of transistors;

receiving a second bias voltage at a first input of a second operational amplifier coupled to a second set of transistors, the first set of transistors and the second set of transistors forming a current mirror, the current mirror coupled to a supply voltage, wherein the first bias voltage and the second bias voltage are determined by a reference voltage circuit;

wherein the first bias voltage differs from the supply voltage;

wherein a first transistor of the first set of transistors has an input coupled to a supply voltage and an output coupled to an input of a first transistor of the second set of transistors, wherein a second transistor of the first set of transistors has an input coupled to the supply voltage and an output coupled to an input of a second transistor of the second set of transistors, and wherein the second transistor of the second set of transistors is directly coupled to the second operational amplifier;

wherein the first transistor of the second set of transistors is coupled to a current source and to a second input of the first operational amplifier to define a first feedback loop;

wherein the current source is an active device that includes cascode transistors;

wherein an output of the first transistor in the first set of transistors is provided as a second input to the second operational amplifier to define a second feedback loop;

wherein the second transistor of the second set of transistors has an output that drives an output current of the current mirror provided to a high speed analog circuit and provided to a different voltage domain, wherein the different voltage domain has a voltage supply limited by the second bias voltage; and wherein each transistor of the second set of transistors is controlled by the second operational amplifier.

17. The method of claim 16, wherein the output current is substantially independent from changes in the supply voltage.

18. The method of claim 16, further comprising providing current to the first transistor in the second set of transistors from the current source.

19. The method of claim 16, wherein the second bias voltage is substantially fixed by the reference voltage circuit.

20. The method of claim 16, wherein the supply voltage is approximately equal to four times a drain to source voltage of one of the transistors in the first set of transistors.

21. The method of claim 20, wherein the supply voltage is less than one volt.

22. The method of claim 16, wherein the high speed analog circuit is an oscillator.

* * * * *